US006309016B1

(12) United States Patent
Aloisi

(10) Patent No.: US 6,309,016 B1
(45) Date of Patent: Oct. 30, 2001

(54) OBJECT HOLDERS AND ORGANIZERS

(76) Inventor: Tania C. Aloisi, 10 Winding Ridge, Clifton Park, NY (US) 12065

( * ) Notice: Subject to any disclaimer, the term of this patent is extended or adjusted under 35 U.S.C. 154(b) by 0 days.

(21) Appl. No.: 09/460,629

(22) Filed: Dec. 14, 1999

Related U.S. Application Data

(63) Continuation-in-part of application No. 29/101,096, filed on Feb. 25, 1999, and a continuation-in-part of application No. 29/101,086, filed on Feb. 25, 1999, and a continuation-in-part of application No. 29/101,085, filed on Feb. 25, 1999, and a continuation-in-part of application No. 29/101,084, filed on Feb. 25, 1999, and a continuation-in-part of application No. 29/095,757, filed on Oct. 29, 1998, and a continuation-in-part of application No. 29/095,756, filed on Oct. 29, 1998, and a continuation-in-part of application No. 29/095,755, filed on Oct. 29, 1998, and a continuation-in-part of application No. 29/095,754, filed on Oct. 29, 1998.

(51) Int. Cl.[7] ..... A47D 11/00; A47D 13/00; A47D 3/00

(52) U.S. Cl. ..... 297/181; 297/188.01; 297/188.04; 108/92; D6/358; D6/359

(58) Field of Search ..... 297/181, 188.01, 297/188.08, 188.04, 188.06; 108/43, 92, 93; D6/358, 359

(56) References Cited

U.S. PATENT DOCUMENTS

D. 68,529 * 6/1925 Graff ..... D6/359
83,801 * 11/1868 Towne ..... 297/188.08 X (List continued on next page.)

FOREIGN PATENT DOCUMENTS

672185 A * 5/1952 (GB) ..... 297/188.08

OTHER PUBLICATIONS

Industrial Design, p. 89, Sep. 1965.*

Sidley: A Hallmark Of Quality, Syd Leach, Inc, 3005 Bellevue Road, Toledo, Ohio 43606, Bubba Bear, Sep. 1965.*

*Primary Examiner*—Peter M. Cuomo
*Assistant Examiner*—Rodney B. White
(74) *Attorney, Agent, or Firm*—Heslin, Rothenberg Farley & Mesiti P.C.

(57) ABSTRACT

Furniture pieces, including tables, shelf units, chairs and combinations of these, are provided, wherein parts of the furniture, such as the back, sides, and shelves, represent parts of the body of a figure, such that the furniture piece is a three-dimensional representation of the figure. An object holder and organizer includes a first side member, a second side member, a horizontally-extending member for supporting the objects, attached to the first side member and the second side member, and a rear member disposed behind the first side member, the second side member, and the horizontally-extending member, wherein the rear member represents at least an upper portion of a figure.

16 Claims, 8 Drawing Sheets

U.S. PATENT DOCUMENTS

| | | | | |
|---|---|---|---|---|
| D. 158,472 | * | 5/1950 | Kurtzman | 297/188.03 X |
| D. 177,922 | * | 6/1956 | Osborn | 297/188.08 X |
| D. 218,370 | | 8/1970 | Benz | D6/1 |
| D. 223,813 | * | 6/1972 | Francken | D6/359 |
| D. 230,916 | | 3/1974 | Rau, Sr. | D6/4 |
| D. 309,988 | * | 8/1990 | Oscar | D6/359 |
| D. 314,870 | | 2/1991 | Walsh | D6/358 |
| D. 320,322 | | 10/1991 | Hendrix | D6/453 |
| D. 333,734 | * | 3/1993 | Wright | D6/358 |
| D. 356,449 | | 3/1995 | Frye | D6/359 |
| D. 411,771 | | 7/1999 | Ellingwood | D6/358 |
| 1,986,563 | * | 1/1935 | Eberhardt | 297/188.01 |
| 3,126,237 | | 3/1964 | Kirk | 312/204 |
| 3,276,399 | * | 10/1966 | Canfield | 108/92 X |
| 4,586,747 | * | 5/1986 | Taylor | 297/181 X |
| 4,695,092 | * | 9/1987 | Hittie | 297/181 X |
| 4,807,929 | * | 2/1989 | Balsbaugh | 297/188.04 |
| 4,909,573 | * | 3/1990 | Barry et al. | 297/181 X |
| 5,112,104 | * | 5/1992 | De Giacomi | 297/181 X |
| 5,137,335 | * | 8/1992 | Marten | 297/181 X |
| 5,354,118 | * | 10/1994 | Barry | 297/181 |
| 5,507,551 | * | 4/1996 | Barry | 297/181 |
| 5,628,255 | * | 5/1997 | Neuner | 108/92 X |
| 5,820,210 | * | 10/1998 | Shipman et al. | 297/188.01 |
| 5,941,599 | * | 8/1999 | Roberts | 297/181 X |
| 6,126,240 | * | 10/2000 | Tse | 297/181 X |

* cited by examiner

OBJECT HOLDERS AND ORGANIZERS

RELATED APPLICATIONS

This application is a continuation-in-part of U.S. patent applications, Ser. Nos. 29/095,754, 29/095/755, 29/095,756, 29/095,757, all filed Oct. 29, 1998, 29/101,084, 29/101,085, 29/101,086, and 29/101,096 all filed Feb. 25, 1999, the entirely of which is incorporated herein by reference.

FIELD OF THE INVENTION

The invention relates to table/shelf units for organizing and holding objects.

COPYRIGHT AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

A need exists for attractive, whimsical shelf units to organize and store objects in many areas of the home. U.S. Pat. Nos. 218,370, 230,916, and D320,322 relate to shelf-type units wherein the side panels represent various figures, specifically, a superhero, an elephant and a dinosaur, respectively. U.S. Pat. No. 3,126,237, relates to a stand for children's clothing, wherein an upright panel representing a figure of a clown has means for hanging clothes attached to the rear. None of the patents relate to a furniture piece wherein the horizontal elements of the piece represent part of the figure, such as the legs or arms. None of the patents relate to a furniture piece wherein functional parts of the piece also represent body parts of a figure, such that the piece is a three-dimensional representation of a figure and at the same time functions as an object holder and organizer

SUMMARY OF THE INVENTION

Therefore, it is an object of the invention to provide furniture pieces, including tables, shelf units, chairs and combinations of these, wherein parts of the furniture, such as the back, sides, and shelves, represent parts of the body of a figure, such that the furniture piece is a three-dimensional representation of the figure. In this context, the term "figure" denotes a pictorial or sculptural representation of a person, cartoon character or an animal, typically, an outline delineating the outward appearance of a person or an animal.

Accordingly, the present invention relates to an object holder and organizer for supporting a plurality of objects. The object holder and organizer comprises a first side member, a second side member, a horizontally-extending member for supporting the objects, attached to the first side member and the second side member, and a rear member disposed behind the first side member, the second side member, and the horizontally-extending member, wherein the rear member represents at least an upper portion of a figure. Preferably, the rear member, the first and second side members, and the horizontally extending member form a three-dimensional representation of the figure. The horizontally-extending member is preferably disposed generally at a height corresponding to an elbow of the figure and represents at least a portion of an arm of the figure. A base may be attached to at least one of the first side member, the second side member, and the rear member, thereby defining a compartment for holding the objects. The first and second side members may extend below the horizontally-extending member. A member in the form of at least a portion of a hand may be attached to a front portion of the horizontally-extending member. The figure may be a human figure, such as an angel, an animal figure or a cartoon figure. A second horizontally-extending member for supporting the objects may be attached to and extend between the first and second side members, representing at least a portion of an arm of the figure. A pair of vertically-extending members may be attached to at least a front portion of the second horizontally-extending member and to the side members, representing at least a portion of a leg of the figure. A third horizontally-extending member for supporting the objects may be attached to and extend between the first and second side member. At least one pocket may be attached to the horizontally-extending member, or to the rear member. A third horizontally-extending member for supporting the objects may be attached to the rear member, wherein the third horizontally-extending member is disposed generally at a height corresponding to a shoulder of the figure.

In another aspect, an object holder according to the present invention comprises a base defining one or more compartments for holding objects, a rear member disposed behind the base, wherein the rear member represents a figure. The figure is preferably a recumbent figure. The base and the rear member preferably form a three-dimensional representation of the figure. A vertically-extending divider for the base, may be provide, wherein the divider is disposed generally at a position corresponding to hips of the figure and representing at least a portion of legs of the figure. A member in the form of at least one foot may be attached to a side portion of the base. The figure may be a human figure, such as an angel, an animal figure, or a cartoon figure.

In yet another aspect, a combination chair and object holder according to the present invention comprises at least two front legs, at least two back legs, a horizontally-extending seat, attached to the at least two front leg and the at least two back legs, a vertically-extending back disposed behind the horizontally-extending seat, wherein the back member represents an upper portion of a figure, the horizontally-extending seat represents an upper portion of the legs of the figure, and the at least two front legs represent lower portions of the legs of the figure. At least one horizontally-extending arm, attached to the back, extending above the horizontally-extending seat, may be disposed generally at a height corresponding to an elbow of the figure, representing at least a portion of an arm of the figure. The horizontally-extending arm may represent a forearm and hand of the figure. The figure may be a human figure, such as an angel, an animal figure, or a cartoon figure.

DETAILED DESCRIPTION OF THE INVENTION

Figure 1:
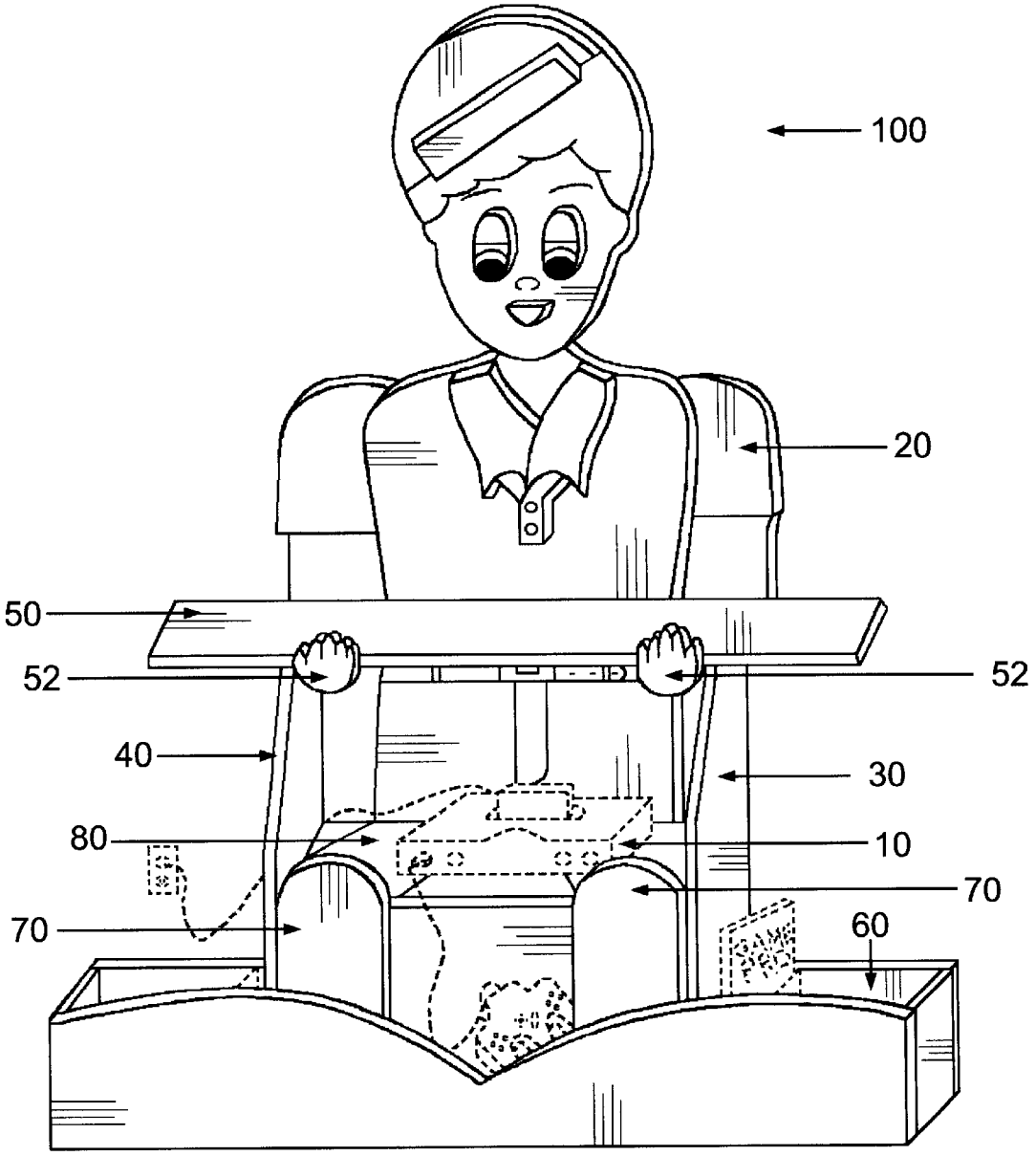
FIG. 1 is a oblique perspective view of an object holder and organizer in the form of a figure of a boy.

FIG. 1 shows an object holder and organizer according to the present invention in the form of a table/shelf unit representing the figure of a boy. Table/shelf unit 100 is adapted for holding or storing a video game unit 10 and associated paraphernalia, including game cartridges, magazines, note pad, and pencils or pens. Rear member 20 is shaped, and/or painted, if desired, to represent the upper portion of the figure of a seated boy. Alternately, another figure could be represented, for example, another human figure, such as an angel or a clown; an animal figure, such as a bear, a dog, or a cat; or a cartoon figure. Rear member 20 is disposed behind a first side member 30, a second side member 40 and a horizontally-extending planar member, or shelf, 50. First and second side members 30 and 40 extend vertically to a height corresponding to the elbow of the boy figure. Shelf 50 is attached to first side member 30 and second side member 40 and forms a representation of a shelf or tray supported on the forearm of the boy figure. Members representing the form of a hand, hand pieces 52, are attached to a front portion of shelf 50. Additional members in the shape of a forearm may be attached to the bottom of shelf 50 to further define the representation of the figure. Shelf 50 is particularly useful for supporting objects used while playing video games. Base 60 defines an additional compartment for holding objects, and includes subcompartments which may contain objects such as magazines or brochures. Base 60 is desirably attached to first side member 30, second side member 40 and rear member 20 to form a rigid unit stably supportable in an upright manner on the floor or the ground. A second shelf 80 is attached to and extends between side members 30 and 40, and is adapted for supporting the controller unit of a video game such as PlayStation®. Shin members 70 represent the front lower portions of the legs of the boy figure, and ate attached to a front portion of shelf 80, and/or to side member 30 and 40. Shelf 50 and shelf 80 define and may be painted to further represent the forearms and/or thighs of the figure, respectively.

FIGS. 2–8 illustrate alternate embodiments of the object holders and organizers of the present invention. Each of the embodiments is a furniture piece wherein the various members or functional parts of the piece are integral with and also represent body parts of a figure, such that the piece defines or forms a three-dimensional representation of a figure.

Figure 2:
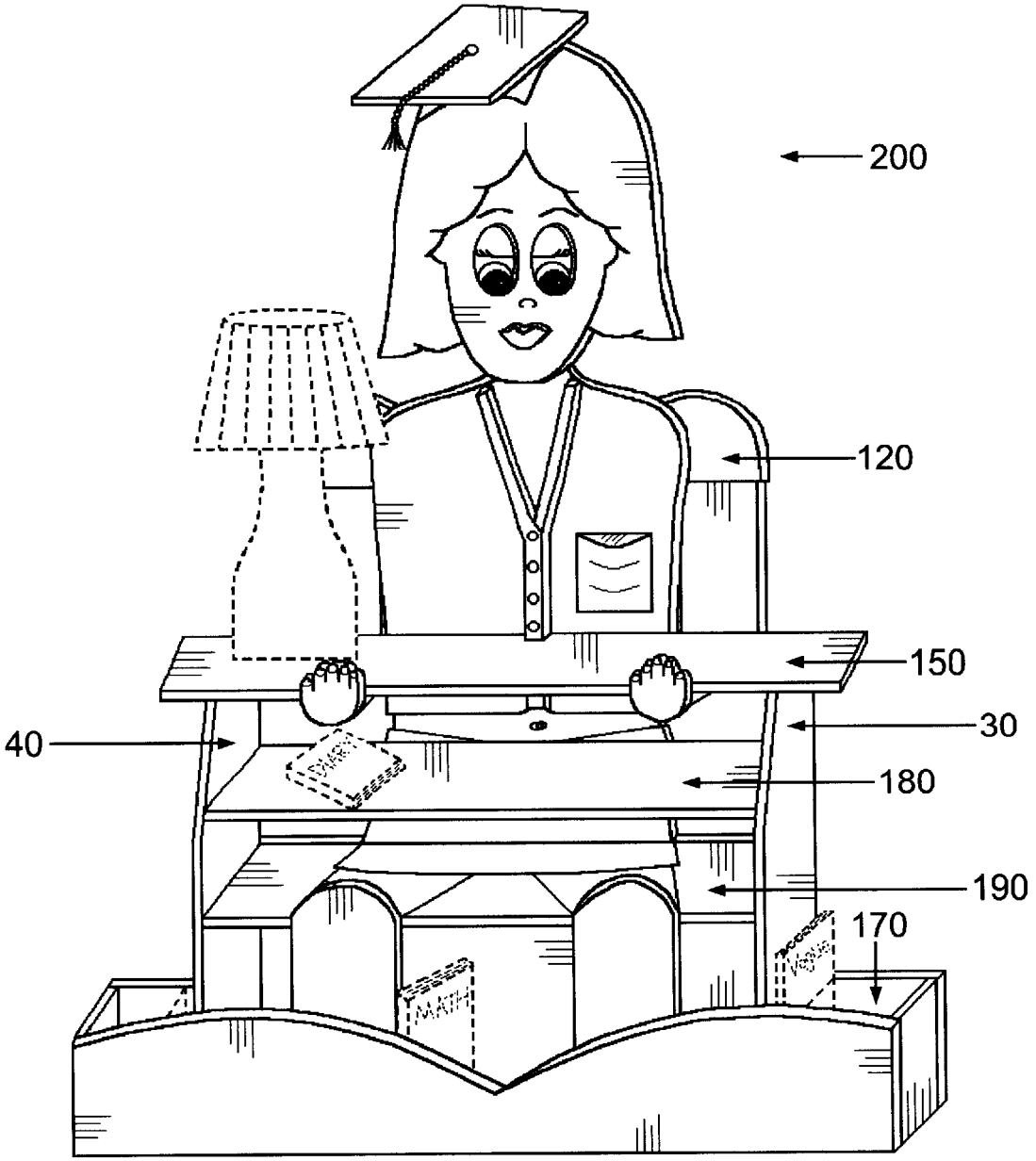
FIG. 2 is a is a oblique perspective view of an object holder and organizer in the form of a teenage girl.

FIG. 2 illustrates a second embodiment, table/shelf unit 200. In this exemplary embodiment, a rear member 120 represents the upper portion of a figure of a teenage girl. Table/shelf unit 200 is adapted to hold personal items such as jewelry, eyeglasses, perfumes and lotions. Books and magazines may be stored in the compartment formed by a base 170. A shelf 150 represents a shelf or tray or tabletop supported on the forearms of the figure and may function to support items such as the lamp depicted in the drawing. Table/shelf unit 200 also includes a second horizontally-extending planar member or shelf 180 and a third horizontally-extending planar member or shelf 190 attached to and extending between first and second side members 30 and 40. Shelf 190 represents the thighs or upper parts of the legs of the figure; shin member 170 represents the shins or lower part of the legs of the figure.

Figure 3:
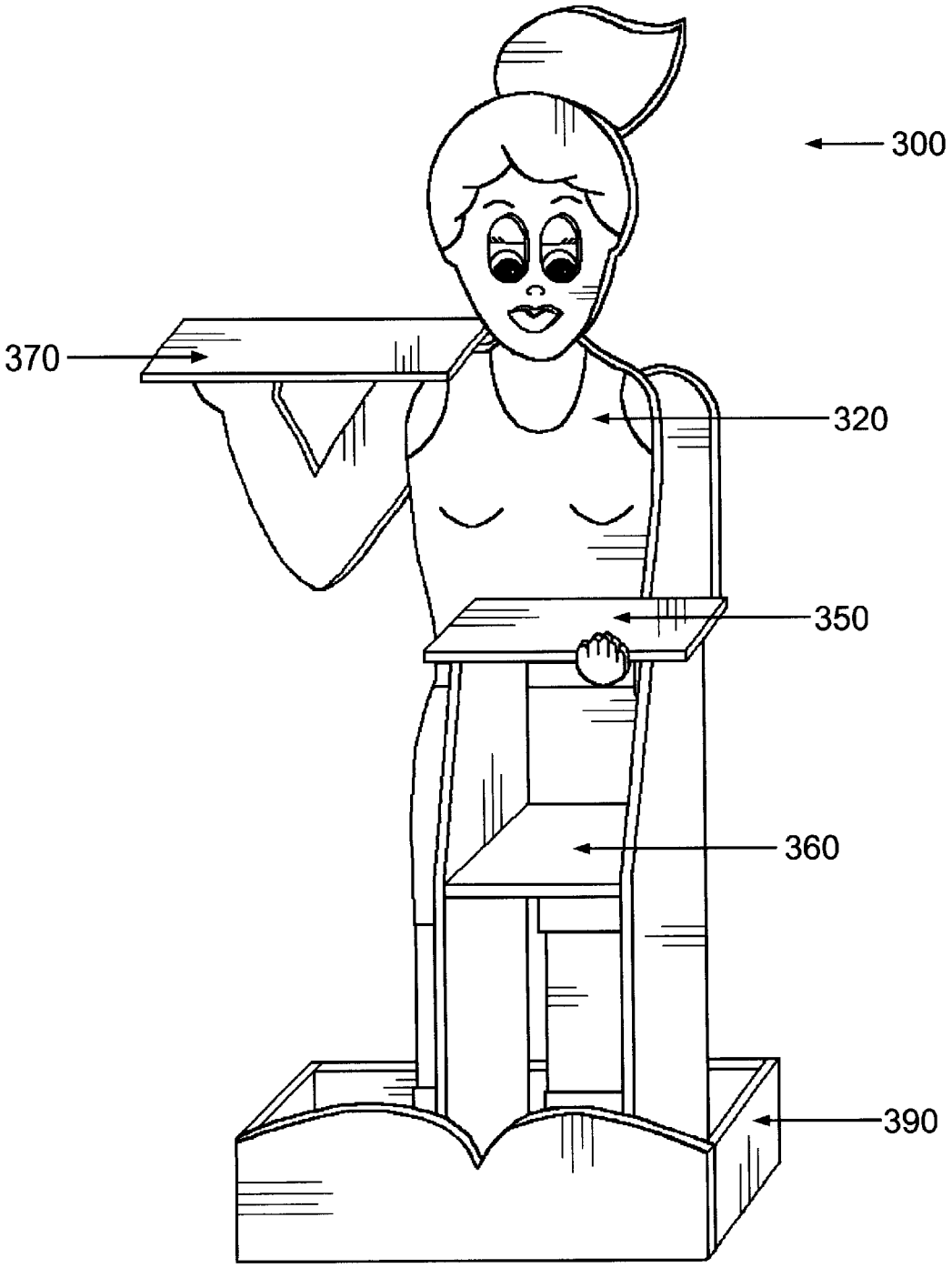
FIG. 3 is a is a oblique perspective view of an object holder and organizer in the form of an exercise figure.

FIG. 3 illustrates a third embodiment, table/shelf unit 300. A rear member 320 represents an exercise figure. Table/shelf unit 300 is adapted to hold items used during exercise, including eyeglasses, remote control, water bottle and towel. These items may be supported by shelves 350 or 360, or by a shelf 370, which is attached to rear member 320 at a height corresponding to the shoulder of the figure of the figure. A base 390 is attached to rear member 380 and may be used to hold and organize articles used during an exercising session.

Figure 4:
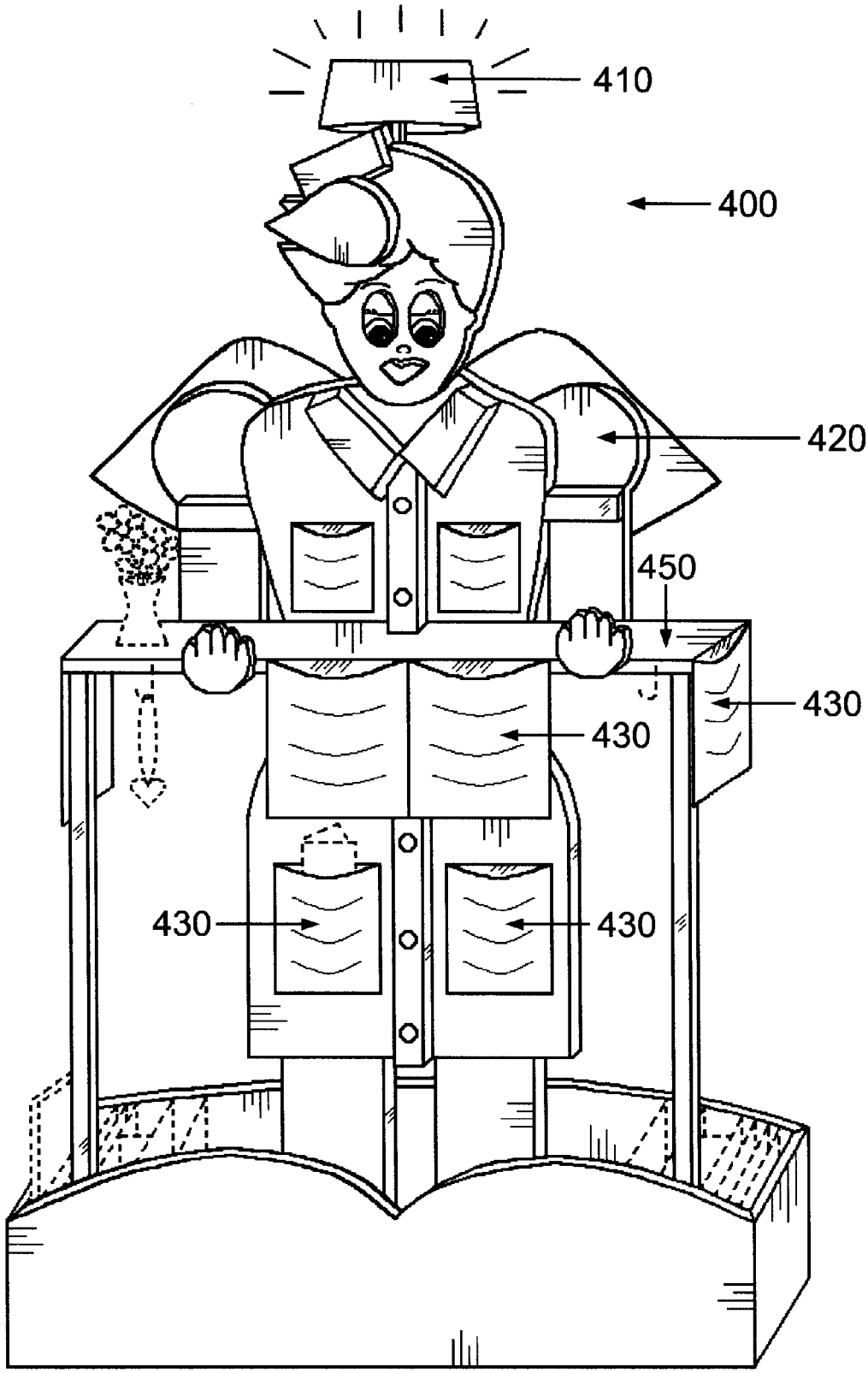
FIG. 4 is a oblique perspective view of an object holder and organizer in the form of an angel nurse.

FIG. 4 illustrates a fourth embodiment, table/shelf unit 400. A rear member 420 represents the figure of an angel nurse. Table/shelf unit 400 is adapted to hold personal items such as jewelry, eyeglasses, slippers, books and magazines in a bedroom. A night light 410 is attached to the top portion of rear member 420. A plurality of pockets 430 are attached to a shelf 450 and to rear member 420 for holding objects such as tissues.

Figure 5:
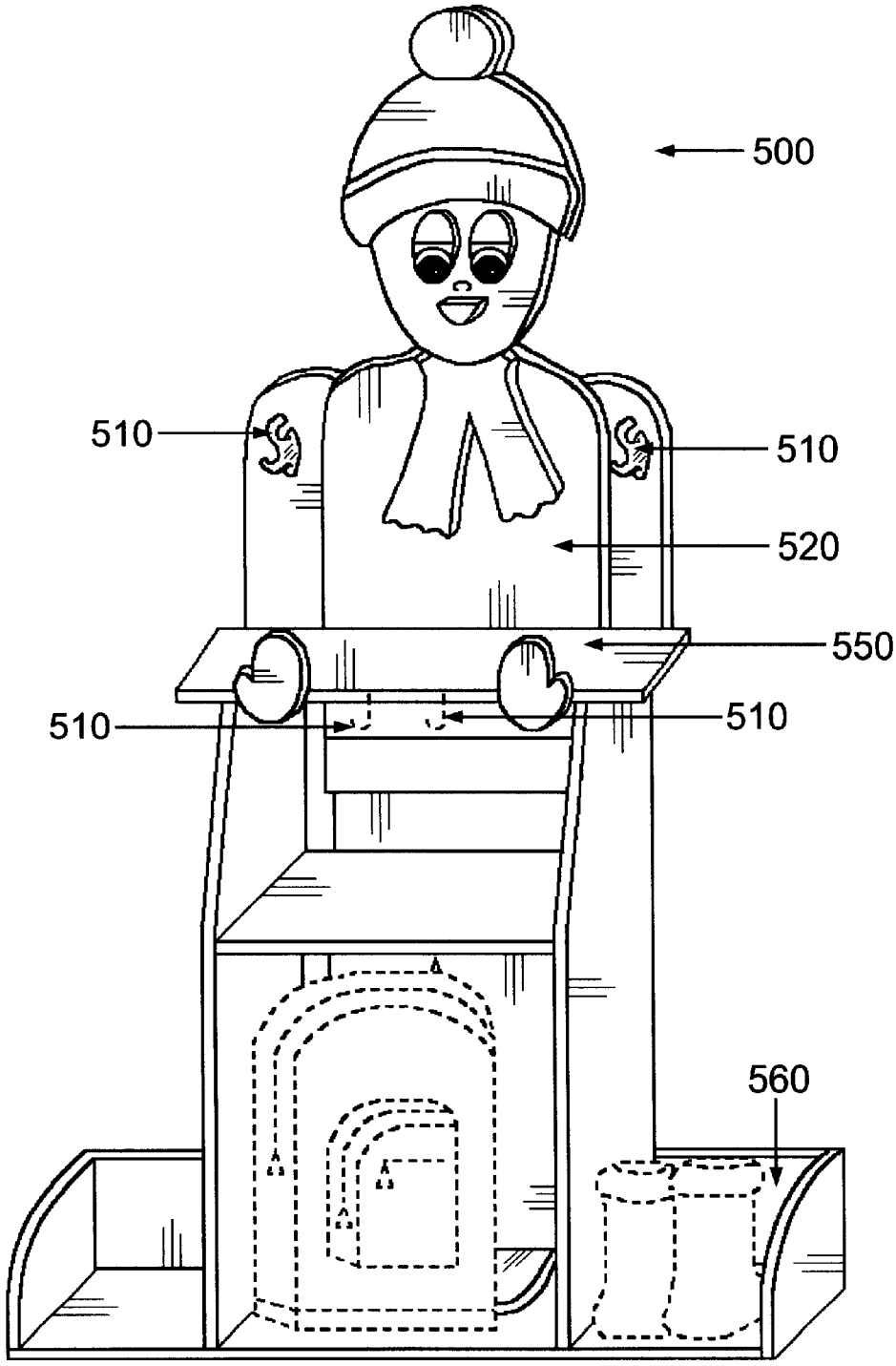
FIG. 5 is a oblique perspective view of an object holder and organizer in the form of a figure of a boy.

FIG. 5 illustrates an fifth embodiment, table/shelf unit 500. A rear member 520 represents the figure of a boy. Table/shelf unit 500 is adapted for holding backpacks, shoes, boots, hats, gloves, coats, and other similar objects. A pair of hooks 510 are attached to rear member 520 and to a shelf 550 for hanging objects such as hats or coats upon. A base 560 defines several compartments that open toward the front of table/shelf unit 500 to permit easy access to objects stored therein, such as a backpack or boots.

Figure 6:
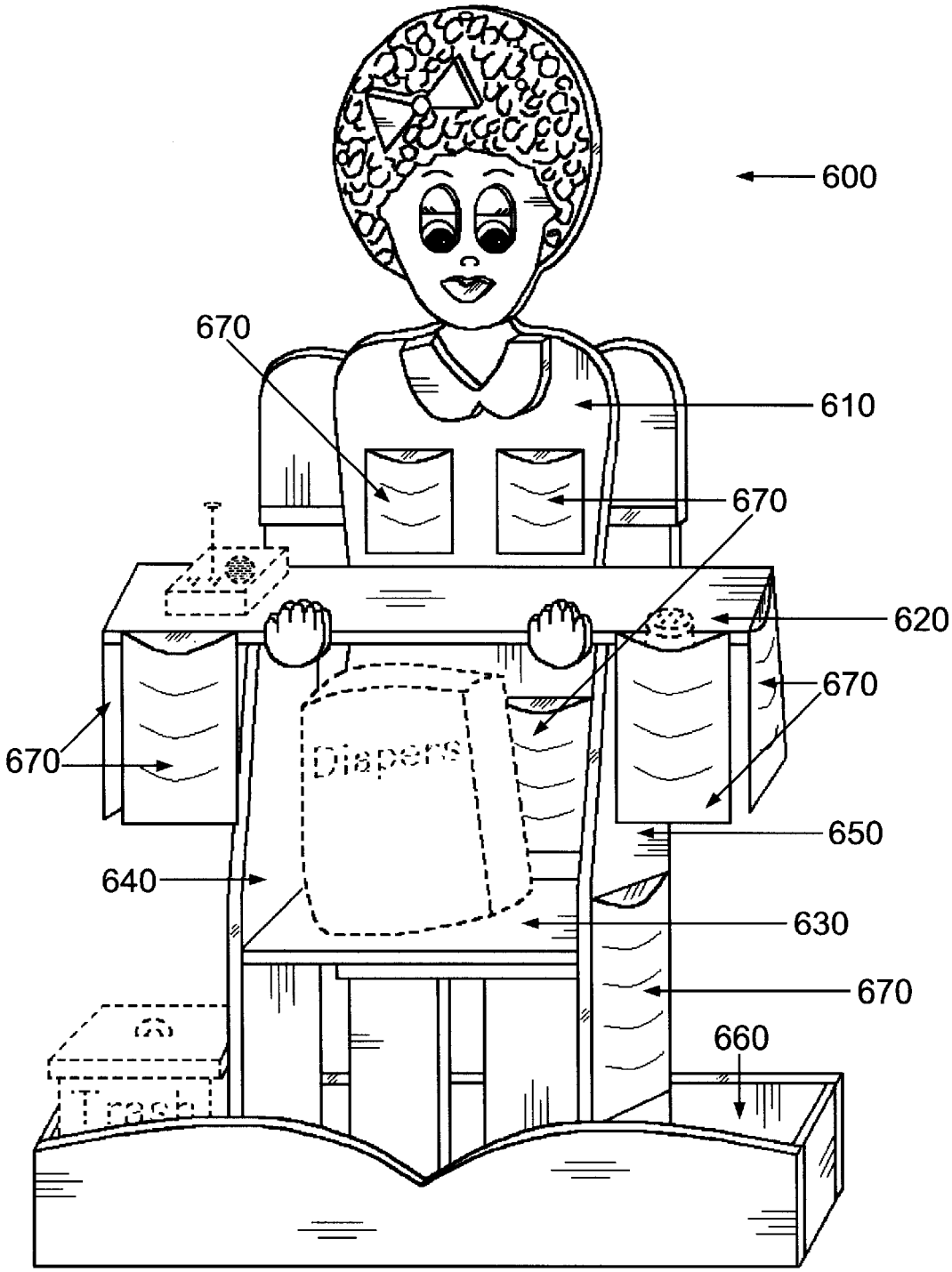
FIG. 6 is a oblique perspective view of an object holder and organizer in the form of a figure of a nanny.

FIG. 6 illustrates a sixth embodiment, table/shelf unit 600. Table/shelf unit 600 is adapted for holding baby products such as diapers, wipes, hair brushes, wash cloths, and toys. A rear member 610 represents a figure of a nanny. A shelf 620 supports articles such as a box of tissues or wipes. A shelf 630, along with side members 640 and 650, define a compartment that is used for the storage of a package of diapers. A base 660 defines a compartment that may be used to hold a trash receptacle. A plurality of pockets 670 are attached to shelf 620, rear member 610 and side member 650.

Figure 7:
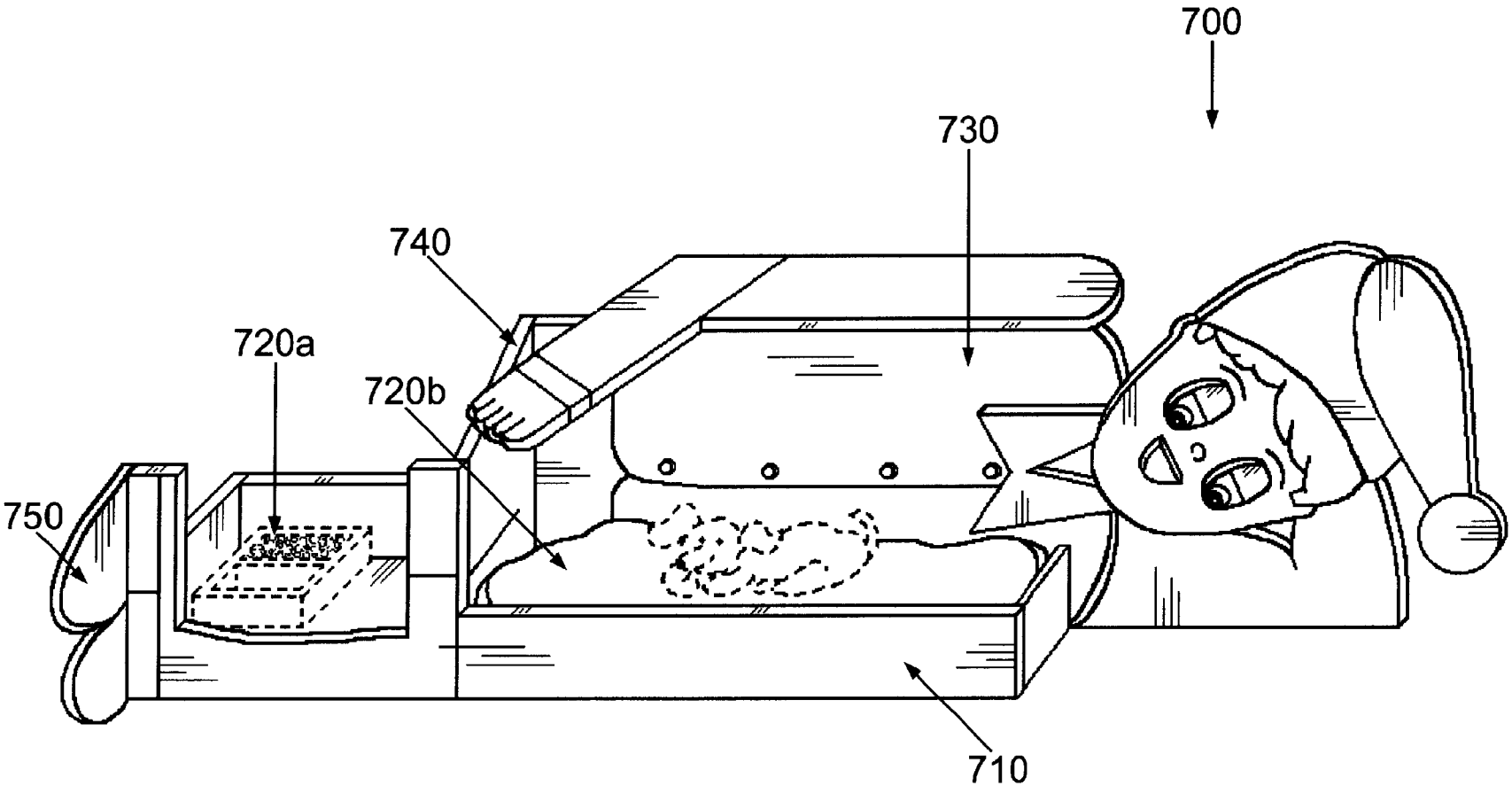
FIG. 7 is a oblique perspective view of a combination pet bed, object holder and organizer in the form of a recumbent boy.

In yet another embodiment, FIG. 7 illustrates a combination pet bed and object holder and organizer 700 that includes a base 710 defining a pair of side-by-side compartments 720*a* and 720*b* for holding objects including a pet bed and food and water. Rear member 730 is disposed behind base 710 and represents a recumbent figure of a boy. A vertically-extending divider 740 is disposed generally at a position corresponding to the hips of the boy figure, and represents the thighs or the upper portions of the legs of the figure. A member in the form of feet, foot piece 750 is attached to a side portion of base 710 opposite to the end of rear member 730 which represents the head.

Figure 8:
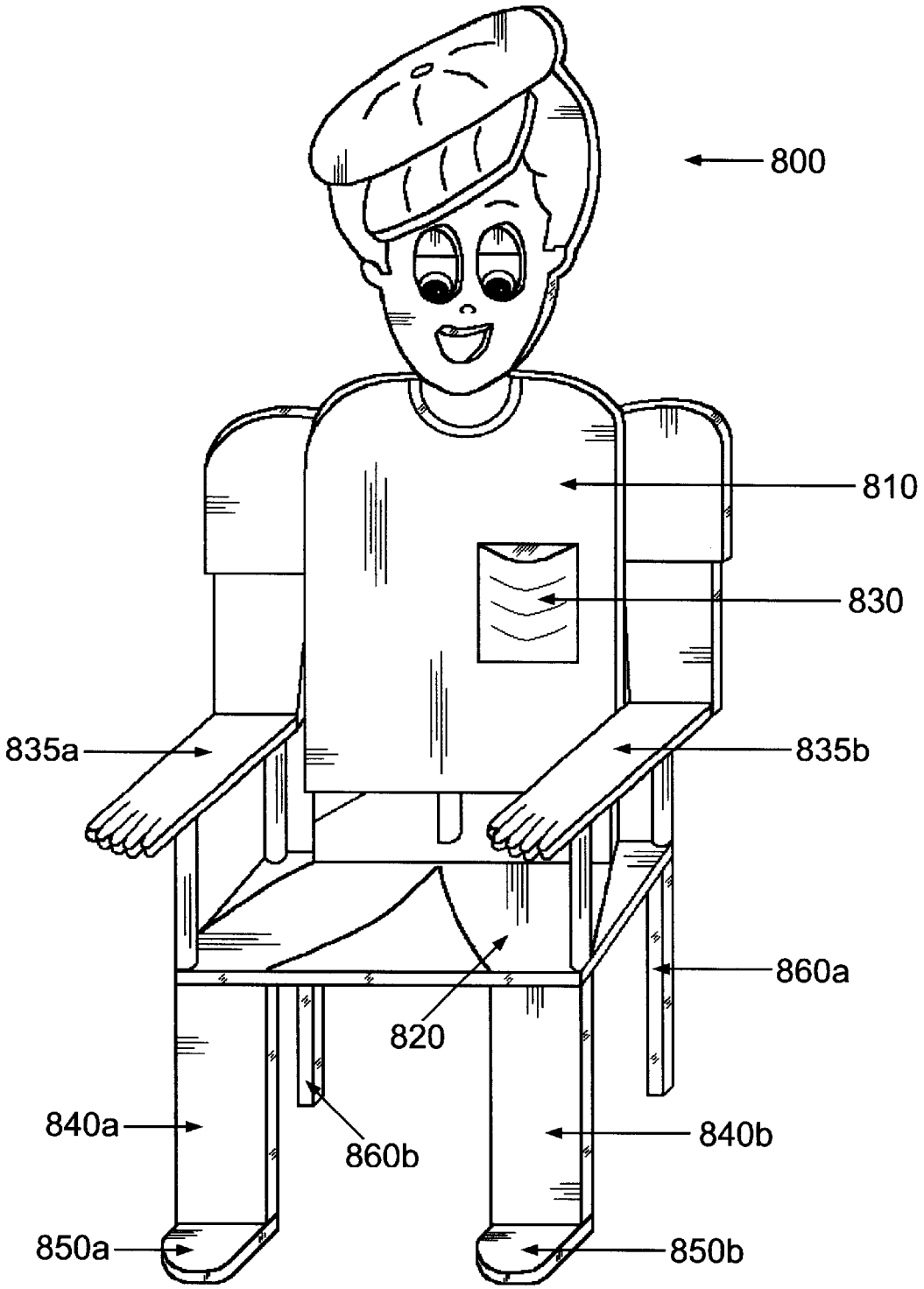
FIG. 8 is a oblique perspective view of a combination chair and object holder in the form of a figure of a boy.

FIG. 8 illustrates yet another embodiment of the present invention which provides a combination chair and object holder 800 adapted as a time out chair for the discipline of children. A back 810 represents the upper portion of a figure of a seated boy. Back 810 is attached to the upper rear portion of a seat 820 which represents the upper portion of the legs of the boy figure, and to a pair of arms 835*a* and 835*b*, representing forearms of the figure, the arms being attached at a height corresponding to an elbow of the boy figure. Pocket 830 is attached to back 810 and may function to hold objects. Chair 800 has two front legs 840*a* and 840*b* which represent the lower portions of the legs of the boy figure, and to which are attached foot pieces 850*a* and 850*b*. A pair of back legs 860*a* and 860*b* are attached to the lower rear portion of seat 820.

What is claimed is:

1. An object holder and organizer for supporting a plurality of objects, and representing a figure of a character having body parts selected from an arm, an elbow, a shoulder and a hand, said object holder and organizer comprising:

a first side member representing a first arm of the figure;

a second side member representing a second arm of the figure;

a horizontally-extending member for supporting the objects, attached to an upper surface of said first arm and said second arm, and disposed generally at a height corresponding to an elbow of the figure; and a rear member disposed behind said first arm, said second arm, and said horizontally-extending member, wherein said rear member represents at least an upper portion of the figure of a character having body parts selected from an arm, an elbow, a shoulder and a hand.

2. The object holder and organizer of claim 1, wherein said rear member, said first and second side members, and said horizontally extending member form a three-dimensional representation of the figure.

3. The object holder and organizer of claim 1, wherein said horizontally-extending member is disposed generally at a height corresponding to an elbow of the figure and represents at least a portion of an arm of the figure.

4. The object holder and organizer of claim 1, further comprising a base attached to at least one of said first side member, said second side member, and said rear member, said base defining a compartment for holding the objects.

5. The object holder and organizer of claim 1, wherein said first and second side members extend below said horizontally-extending member.

6. The object holder and organizer of claim 1, further comprising a member in the form of at least a portion of a hand attached to a front portion of said horizontally-extending member.

7. The object holder and organizer of claim 1, wherein the figure is a human figure.

8. The object holder and organizer of claim 1, wherein the figure is an animal figure.

9. The object holder and organizer of claim 1, wherein the figure is a cartoon figure.

10. The object holder and organizer of claim 1, wherein the figure is an angel.

11. The object holder and organizer of claim 1, further comprising a second horizontally-extending member for supporting the objects attached to and extending between said first and second side members.

12. The object holder and organizer of claim 11, further comprising a third horizontally-extending member for supporting the objects attached to said rear member, wherein said third horizontally-extending member is disposed generally at a height corresponding to a shoulder of the figure.

13. The object holder and organizer of claim 11, further comprising a pair of vertically-extending members attached to at least a front portion of said second horizontally-extending member and to said side members and representing at least a portion of a leg of the figure.

14. The object holder and organizer of claim 1, further comprising a third horizontally-extending member for supporting the objects attached to and extending between said first and second side member.

15. The object holder and organizer of claim 1, further comprising at least one pocket attached to said horizontally-extending member.

16. The object holder and organizer of claim 1, further comprising at least one pocket attached to said rear member.

* * * * *